US010546553B2

(12) United States Patent
Bian et al.

(10) Patent No.: US 10,546,553 B2
(45) Date of Patent: Jan. 28, 2020

(54) IMAGE PROCESSING APPARATUS, IMAGE PROCESSING METHOD AND DISPLAY APPARATUS

(71) Applicant: SHANGHAI TIANMA AM-OLED CO., LTD., Shanghai (CN)

(72) Inventors: Qing Bian, Shanghai (CN); Bojia Lv, Shanghai (CN); Xiangzi Kong, Shanghai (CN); Bin Yang, Shanghai (CN); Hongling Wang, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 26 days.

(21) Appl. No.: 15/888,099

(22) Filed: Feb. 5, 2018

(65) Prior Publication Data

US 2018/0158434 A1 Jun. 7, 2018

(30) Foreign Application Priority Data

Sep. 29, 2017 (CN) ..... 2017 1 0911453

(51) Int. Cl.

| | |
|---|---|
| ***G03G 5/06*** | (2006.01) |
| ***G09G 5/06*** | (2006.01) |
| ***G09G 5/10*** | (2006.01) |

(52) U.S. Cl.

CPC ..... *G09G 5/06* (2013.01); *G09G 5/10* (2013.01); *G09G 2320/0233* (2013.01); *G09G 2320/0626* (2013.01)

(58) Field of Classification Search

None

See application file for complete search history.

(56) References Cited

U.S. PATENT DOCUMENTS

| | | | | |
|---|---|---|---|---|
| 6,608,942 | B1 * | 8/2003 | Le | G06T 5/002 382/199 |
| 2017/0243562 | A1 * | 8/2017 | Hu | G09G 3/2092 |
| 2017/0322446 | A1 * | 11/2017 | Tae | G02F 1/133345 |
| 2018/0122284 | A1 * | 5/2018 | Zhang | G09G 3/006 |

FOREIGN PATENT DOCUMENTS

| | | | |
|---|---|---|---|
| CN | 101097674 | A | 1/2008 |
| CN | 101867682 | A | 10/2010 |
| CN | 102595033 | A | 7/2012 |
| CN | 104505043 | A | 4/2015 |
| CN | 104992657 | A | 10/2015 |
| CN | 105427258 | A | 3/2016 |
| CN | 105590605 | A | 5/2016 |
| CN | 106469533 | A | 3/2017 |
| CN | 106530994 | A | 3/2017 |

* cited by examiner

*Primary Examiner* — Kyle Zhai

(74) *Attorney, Agent, or Firm* — Kilpatrick Townsend & Stockton, LLP

(57) ABSTRACT

The present disclosure provides an image processing apparatus, an image processing method and a display apparatus. Where the image processing method includes: receiving a signal of an image to be displayed; correcting the grayscale of each pixel in the image to be displayed according to a pre-created correction data table including pixel positions, display correction data and edge correction data; and displaying according to the corrected grayscale of each pixel.

20 Claims, 12 Drawing Sheets

IMAGE PROCESSING APPARATUS, IMAGE PROCESSING METHOD AND DISPLAY APPARATUS

This application claims the benefit of Chinese Patent Application No. CN 201710911453.3, filed with the Chinese Patent Office on Sep. 29, 2017, which is hereby incorporated by reference in its entirety.

FIELD

The present disclosure relates to the technical field of displaying, and particularly to an image processing method, an image processing apparatus, an image processing system and a display apparatus.

BACKGROUND

With the development of display screen technology, a full screen came into being. Compared with a normal display screen, the full screen has a larger proportion of display area and a super narrow border, which can greatly improve the viewer's visual experience. In addition, in order to meet special needs, the display screen can also be made into a special shape, such as a circular display screen, to expand the application scope of the display screen. However, whether it is a full screen or a display screen with a special shape, the shapes of their corners are different from the shape of corners of a normal display. Taking a full screen as an example, in order to reduce the occupied area of the border as much as possible when making a full screen, the corners are usually configured as arc-shaped, as shown in the solid line frame in FIG. 1A. Therefore, since the corners are arc-shaped, a sawtooth phenomenon appears at the edge of a displayer when displaying an image, thereby affecting the display effect and the viewing effect. Based on this, how to eliminate the sawtooth phenomenon at the edge and improve the display effect and the viewing effect is solved.

SUMMARY

The embodiments of the present disclosure provide an image processing apparatus, an image processing method and a display apparatus, so as to solve the problem of how to eliminate the sawtooth phenomenon at the edge and improve the display effect and the viewing effect, in the prior art.

An embodiment of the present disclosure provides an image processing apparatus, where the image processing apparatus includes: a receiving device configured to receive a signal of an image to be displayed; a correction processing device configured to correct grayscale of each pixel in the image to be displayed according to a pre-created correction data table including pixel positions, display correction data and edge correction data; and a displaying device configured to display according to the corrected grayscale of each pixel.

In another aspect, an embodiment of the present disclosure further provides an image processing method, where the method includes: receiving a signal of an image to be displayed; correcting grayscale of each pixel in the image to be displayed according to a pre-created correction data table including pixel positions, display correction data and edge correction data; and displaying according to the corrected grayscale of each pixel.

In another aspect, an embodiment of the present disclosure further provides a display apparatus, where the display apparatus includes: the receiving device, the correction processing device and the displaying device in the above image processing apparatus provided in the embodiment of the present disclosure.

DETAILED DESCRIPTION OF THE EMBODIMENTS

Figure 1A:
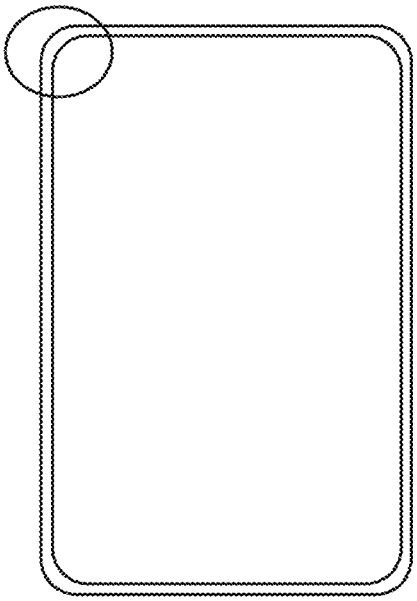
FIG. 1A is a schematic structural diagram of a full-screen mobile phone in the prior art.
Figure 1B:
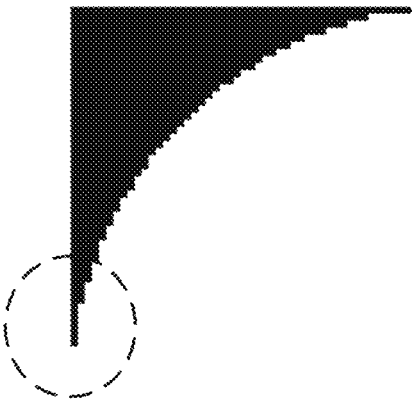
FIG. 1B is a schematic diagram of the display effect of the edge position of a full-screen display apparatus in the prior art.

Embodiments of an image processing method, an image processing apparatus, an image processing system and a display apparatus provided in the embodiments of the present disclosure are described in detail below with reference to the drawings. In the research, the inventor found that in the case of a full-screen display apparatus, the corners are usually arranged in an arc shape to facilitate reducing the occupied area of the border, as shown by the solid-line circle in FIG. 1A, so that a part of the edge of the display panel (i.e., the part in the solid-line circle) may show a sawtooth phenomenon when the display panel displays an image, as shown in FIG. 1B, which may affect the display effect and the viewing effect.

Figure 1C:
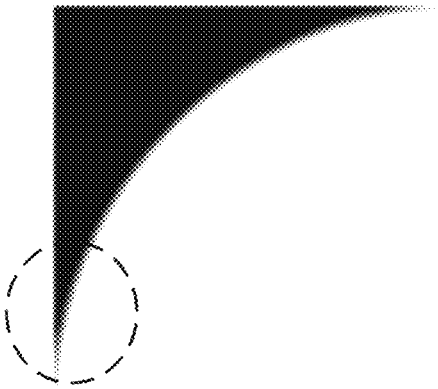
FIG. 1C is a schematic diagram of the display effect after the edge position of a full-screen mobile phone is subjected to edge correction by using the prior art.

In order to eliminate the sawtooth phenomenon on the edge, the edge correction algorithm is usually added to a drive chip. The core of the algorithm is to define the position of the center of the circle firstly and then calculate the distance from pixels at the edge to the center of the circle and carry out the correction according to the distance so that the display effect in the dotted circle as shown in FIG. 1B is corrected to the display effect in the dotted circle as shown in FIG. 1C, which effectively improves the sawtooth phenomenon. However, although this algorithm may effectively eliminate the sawtooth phenomenon, the algorithm is only applicable to an edge position with a standard circular arc corner, such as the rounded corner in the solid-line circle in FIG. 1A) but not applicable to edge positions of other shapes; moreover, the algorithm is more complex and occupies more logic resources of the drive chip, which may affect the processing speed of the a display.

Therefore, an embodiment of the present disclosure provides an image processing method for implementing edge correction processing while performing display correction processing, and for performing edge correction processing at an edge of any shape while avoiding occupation of too many logic resources in an image processing system.

Figure 2:
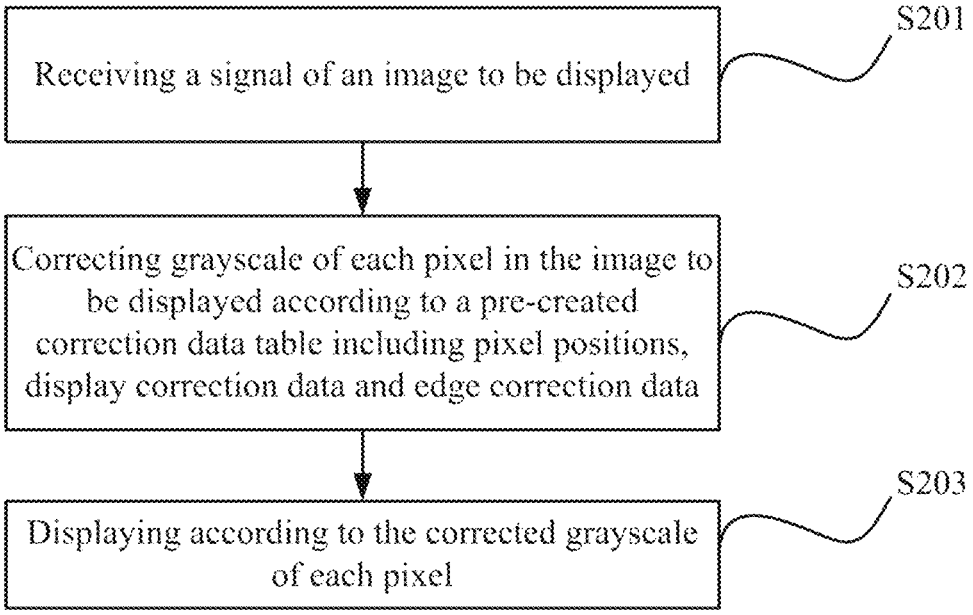
FIG. 2 and FIG. 3 are respectively flowcharts of image processing methods provided in embodiments of the present disclosure.

In one embodiment, the image processing method provided by the embodiment of the present disclosure, as shown in FIG. 2, may include the following operations.

S201: receiving a signal of an image to be displayed.

S202: correcting grayscale of each pixel in the image to be displayed according to a pre-created correction data table including pixel positions, display correction data and edge correction data.

S203: displaying according to the corrected grayscale of each pixel.

It should be noted that for an ordinary display screen, the outline shape of a display area of a display panel is generally an ordinary rectangle; and for a special-shaped display screen, in order to meet certain needs, the outline shape of a display area in the display panel is set as a special shape, such as a rectangle with a rounded corner, a rounded rectangle with a hollow structure at one end, or a circle, etc., which makes the edge of the display screen show a sawtooth phenomenon when the display screen displays an image, thus affecting the viewing effect. The image processing method provided by the embodiment of the present disclosure corrects the grayscales of pixels in an image to be displayed without being limited by the shape of a display panel, and can be applied to a display panel of any shape (at least including the display panels in the above several special-shaped display screens) and therefore has higher flexibility. In addition, since the display correction data and edge correction data of each pixel are included in the pre-created correction data table, display correction data and edge correction data are merged in one table, which effectively reduces logic resources occupied in an image processing system; and, when the display effect is corrected, the edge effect of each pixel is also corrected at the same time, thereby effectively improving the display effect of a display.

In one embodiment, the image processing method provided in the embodiment of the present disclosure introduces the edge correction data into the correction data table according to the characteristics of the display correction processing so that the correction data table includes not only the display correction data but also the edge correction data, thereby implementing display correction processing and edge correction process at the same time when the grayscale of each pixel in the image to be displayed is corrected. In this way, the display efficiency and the viewing efficiency of the display panel are effectively improved and the correction processing speed of the system is also enhanced, without increasing the occupancy of the logic resources in the system.

It should be noted that, in the foregoing image processing method provided by the embodiment of the present disclosure, during the correction for the grayscales of the pixels in the image to be displayed, since each pixel corresponds to a display correction data and an edge correction data, the display correction processing and edge correction processing are performed for each pixel, and the correction processing may not differ due to different pixel positions of pixels. In this way, the correction processing for all pixels may be realized by using one algorithm, which effectively simplifies the correction processing process.

Figure 3:
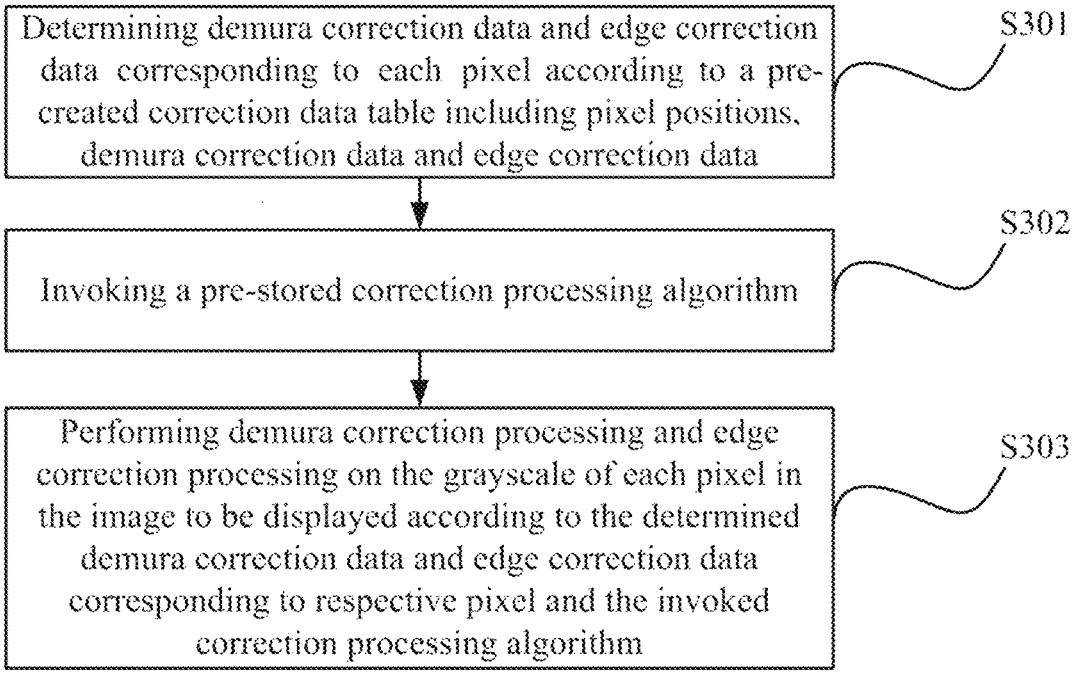

In an implementation, since displays become larger and larger, mura and other poor performance have a great impact on display quality and display effect, mura mainly refers to uneven brightness or color display of an effective display area. Therefore, in order to alleviate the mura phenomenon, demura is introduced, that is, the brightness or color of the effective display area is compensated and corrected so that the brightness or color of the effective display area is displayed more evenly. Based on this, when the display correction data is demura correction data, the correcting grayscale of each pixel in the image to be displayed according to a pre-created correction data table including pixel positions, display correction data and edge correction data in the operation S202 in the foregoing image processing method provided in the embodiment of the present disclosure, may include the following operations, as shown in FIG. 3.

S301: determining demura correction data and edge correction data corresponding to respective pixel according to a pre-created correction data table including pixel positions, demura correction data and edge correction data.

S302: invoking a pre-stored correction processing algorithm.

S303: performing demura correction processing and edge correction processing on the grayscale of each pixel in the image to be displayed according to the determined demura correction data and edge correction data corresponding to respective pixel and the invoked correction processing algorithm.

In one embodiment, when determining the demura correction data and the edge correction data corresponding to respective pixel and invoking the pre-stored correction algorithm, before the demura correction process and the edge correction process are performed on the grayscale of each pixel in the image to be displayed, the sequence of the two operations is not limited to the sequence described above.

The sequence also could be to invoke the pre-stored correction processing algorithm firstly and then determine the demura correction data and edge correction data corresponding to each pixel, as long as the demura correction data and edge correction data corresponding to each pixel are determined and the correction processing algorithm is invoked to perform demura correction processing and edge correction processing at the same time before the grayscales of the pixels in the image to be displayed are corrected, which is not limited herein.

In one embodiment, in order to reduce the computation amount of the image processing and improve the processing speed, in operation S303 in the foregoing image processing method provided in the embodiment of the present disclosure, one correction processing algorithm is provided, and the demura correction processing and the edge correction processing may be performed on the grayscale of each pixel in the image to be displayed through one correction processing algorithm. Further, the correction processing process may include: performing demura correction processing and edge correction processing on the grayscale of each pixel in the image to be displayed by using the following formula:

$$B_x=(A_x+D_{1x})\times D_{2x}$$

where $A_x$ represents the grayscale of the X-th pixel before performing the demura correction processing and the edge correction processing, $B_x$ represents the grayscale of the X-th pixel after performing the demura correction processing and the edge correction processing, $D_{1x}$ represents the demura correction data corresponding to the X-th pixel, and $D_{2x}$ represents the edge correction data corresponding to the X-th pixel.

For example, for the pixel P1, if its grayscale $A_1$ is 222 before performing the demura correction processing and the edge correction processing, the demura correction data $D_{11}$ corresponding to the pixel P1 is 2, and the edge correction data $D_{21}$ corresponding to the pixel P1 is 10%, and then, according to the above formula, the grayscale $B_1$ of the pixel P1 after performing the demura correction processing and the edge correction processing is as follows: B1

$$=(A1+D11)\times D21=(222+2)\times 0.1\approx 22.$$

In one embodiment, the above demura correction data may be a positive value or a negative value, which may need to be determined after comparing the actual brightness and the target brightness of the pixel; and the above-mentioned edge correction data may be a percentage, or an integer, or a decimal, which may need to be determined according to the pixel position of the pixel and a preset edge correction rule. Reference is made to the following for the method of determining the edge correction data and the demura correction data.

It should be noted that the process of performing demura correction processing and edge correction processing on the grayscale of each pixel in the image to be displayed is not limited to the above formula but may also employ other formulas and algorithms that may implement demura correction processing and edge correction processing at the same time, which is not limited herein.

Figure 4:
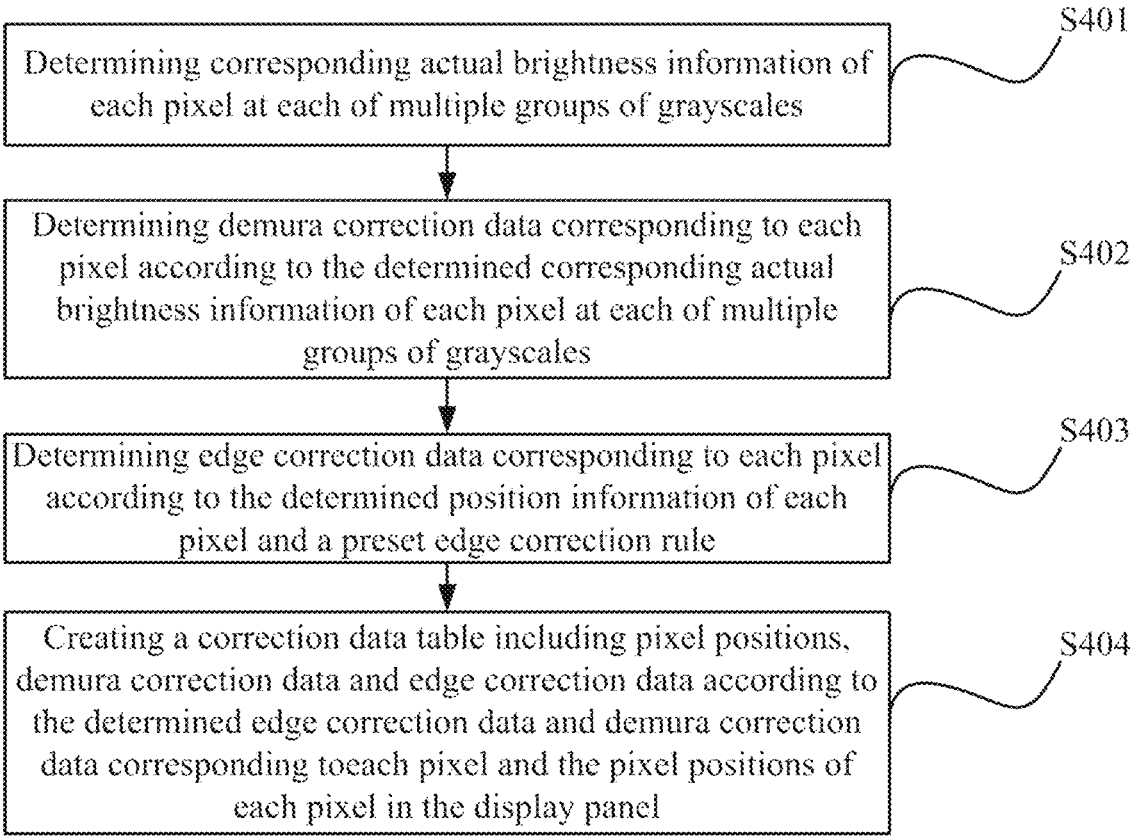
FIG. 4 is a flowchart of a method for creating a correction data table including pixel positions, demura correction data and edge correction data according to an embodiment of the present disclosure.

In an implementation, in order to implement demura correction processing and edge correction processing for the grayscale of each pixel and avoid occupying logical resources in the image processing system, the edge correction data and the demura correction data may be merged into one correction data table. Therefore, it is critical to created such as a correction data table including the edge correction data and the demura correction data. Therefore, in the foregoing image processing method provided in the embodiment of the present disclosure, as shown in FIG. 4, before the operation of receiving the signal of the image to be displayed, the method for creating a correction data table including pixel positions, demura correction data and edge correction data is as follows.

S401: determining corresponding actual brightness information of each pixel at each of multiple groups of grayscales.

S402: determining demura correction data corresponding to each pixel according to the determined corresponding actual brightness information of each pixel at each of multiple groups of grayscales.

S403: determining edge correction data corresponding to each pixel according to the determined position information of each pixel and a preset edge correction rule.

S404: creating a correction data table including pixel positions, demura correction data and edge correction data according to the determined edge correction data and demura correction data corresponding to each pixel and the pixel positions of each pixel in the display panel.

In one embodiment, in order to store the created correction data table including pixel positions, demura correction data and edge correction data so as to be used subsequently, after creating the correction table including the pixel positions, demura correction data and edge correction data in the operation S404 in the foregoing image processing method provided in the embodiment of the present disclosure, as shown in FIG. 4, the method further includes: S405: burning the correction data table onto a memory, so that the correction data table is invoked, read or stored by other devices (such as a drive chip) and occupation of the memory in the drive chip may be favorably reduced.

In one embodiment, the memory may be a flash memory, and of course also may be other memories which may store the correction data table, which is not limited herein. In addition, the image processing system includes many devices, such as a drive chip and a flash memory; after the created correction data table is stored in the flash memory, the drive chip first invokes the correction data table from the flash memory before driving the display panel to display the image; after receiving the signal of the image to be displayed, the drive chip corrects the grayscale of each pixel according to the invoked correction data table and then outputs the processed grayscale of each pixel for displaying the image. Since the correction data table is pre-stored in the flash memory, the occupation of logic resources inside the driving chip may be effectively reduced and the operation speed of the drive chip may be enhanced.

In one embodiment, in order to facilitate the transmission of data, during the transmission of data between different devices, compressed packets are usually transmitted. Therefore, when the drive chip invokes the correction data table from the flash memory, a compressed packet including the correction data table is actually invoked, and then the drive chip decompresses the packet to obtain the correction data table to correct the grayscale of each pixel in the image to be displayed.

Figure 5A:
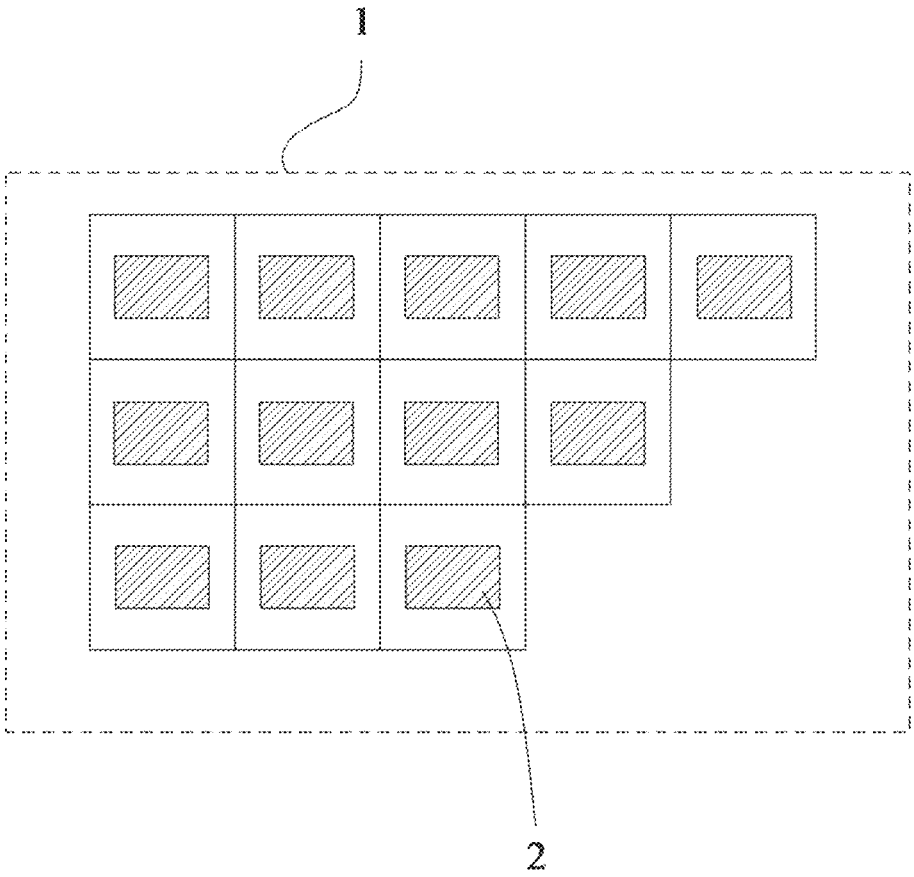
FIG. 5A is a schematic structural diagram of a correction data table provided in an embodiment of the present disclosure.

In an implementation, when creating the correction data table, in order to facilitate reading the correction data corresponding to each pixel and speeding up the image processing, in the foregoing image processing method provided by the embodiment of the present disclosure, as shown in FIG. 5A, the positions of each pixel in the correction data table 1 and the positions of each pixel in the display area are in one-to-one correspondence; and a correction data group 2, which is composed of the demura correction data and the edge correction data corresponding to a pixel, is stored in the position of the pixel in the correction data table 1.

Figure 5B:
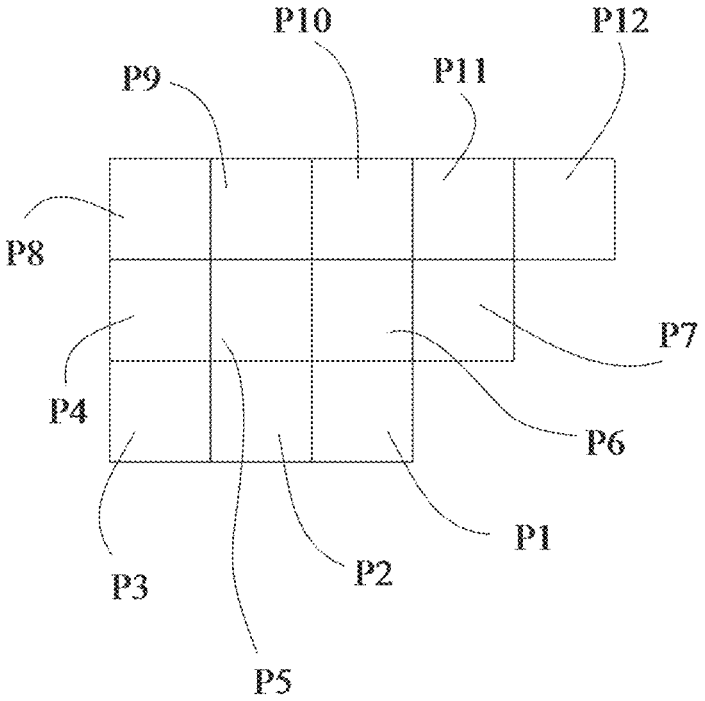
FIG. 5B is a schematic structural diagram of pixel arrangement in a display panel provided in an embodiment of the present disclosure.

In one embodiment, as shown in FIG. 5A and FIG. 5B, taking 12 pixels (such as the pixel P1 to the pixel P12) as an example, FIG. 5A shows the arrangement of edge correction data and demura correction data corresponding to each pixel in the correction data table 1; FIG. 5B shows the arrangement of the pixels in the display panel. Taking the pixel P8 as an example, the pixel P8 is located at the upper left corner in FIG. 5B, and then the pixel position of the pixel P8 in FIG. 5B is also the upper left corner. In addition, the edge correction data and the demura correction data of the pixel P8 form a correction data group 2 and the correction data group 2 is stored at the upper left corner. In this way, when the drive chip corrects the grayscales of the pixels, correction data corresponding to the pixels may be quickly read to perform the demura correction processing and edge correction processing on the pixels, thus effectively improving the image processing efficiency.

Figure 6A:
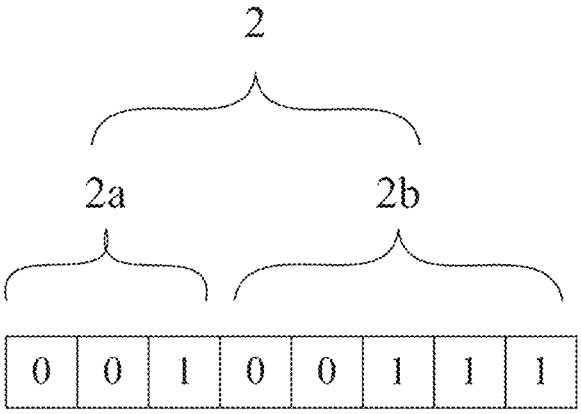
FIG. 6A is a first schematic structural diagram of a correction data group provided in an embodiment of the present disclosure.

Further, in the image processing method provided by the embodiment of the present disclosure, the correction data group may include n bits, of which m bits are edge correction data and (n-m) bits are demura correction data; where n is 8 or 10, and m is a positive integer less than n. For example, as shown in FIG. 6A, if n is 8 and in is 3, then in the correction data group 2,3 bits are the edge correction data 2*a* and 5 bits are the demura correction data 2*b*. In one embodiment, the value of m is not limited to 3, but may also be 2,5, or any other number as long as it may represent the edge correction data of each pixel, which is not limited herein.

Figure 6B:
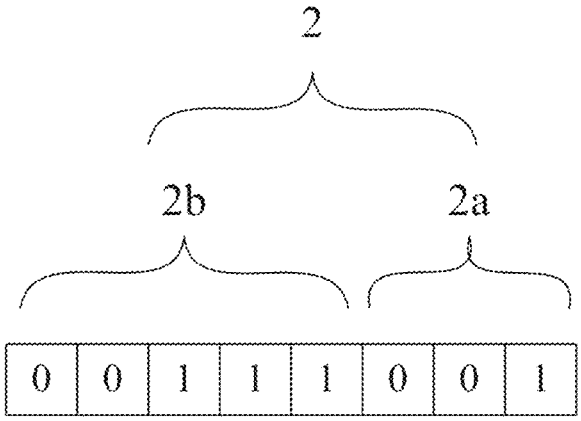
FIG. 6B is a second schematic structural diagram of a correction data group provided in an embodiment of the present disclosure.

In one embodiment, in the correction data group 2, the edge correction data 2*a* may be located in the front of the correction data group 2 and the demura correction data 2*b* may be located behind the edge correction data 2*a* as shown in FIG. 6A. Alternatively, as shown in FIG. 6*b*, the demura correction data 2*b* is located in the front of the correction data group 2 and the edge correction data 2*a* is located behind the demura correction data 2*b*. Further, the edge correction data 2*a* may also be located at the middle position in the correction data group 2 and the data 2*b* is located at an edge of the correction data 2 (not shown), which is not limited herein.

In addition, although the demura correction data and edge correction data of a pixel form a correction data group stored in the correction data table, but the demura correction data and edge correction data has nothing to do with each other and will not interact with each other, i.e., the two types of correction data are independent of each other; therefore, for the display panels with different edge shapes, during the creation of the correction data table, in the case that the grayscales of the pixels are unchanged and only the shape of the display panel is changed, only the edge correction data of the corresponding pixels may need to be modified, without affecting the demura correction data, making the correction data table more flexible and versatile.

Figure 7:
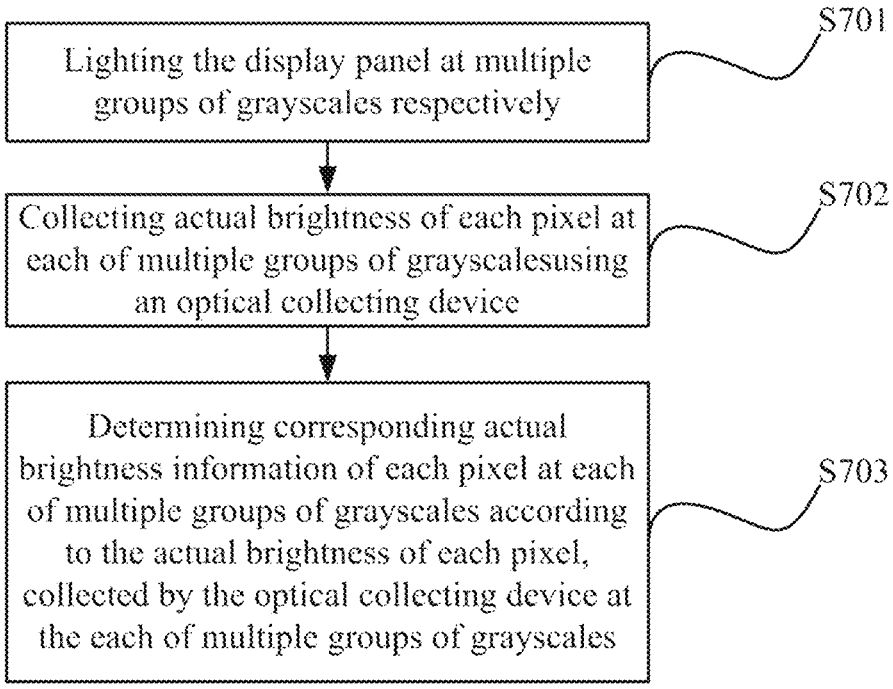
FIG. 7 is a flowchart of a method for determining actual brightness information of each pixel according to an embodiment of the present disclosure.

In an implementation, in order to accurately determine the corresponding actual brightness information of each pixel at each of multiple groups of grayscales to further determine the demura correction data corresponding to each pixel, determining the corresponding actual brightness information of each pixel at each of multiple groups of grayscales in the operation S401 in the foregoing image processing method provided in the embodiment of the present disclosure, may include the following operations, as shown in FIG. 7.

S701: lighting the display panel at multiple groups of grayscales respectively.

S702: collecting actual brightness of each pixel at each of multiple groups of grayscales using an optical collecting device.

S703: determining corresponding actual brightness information of each pixel at each of multiple groups of grayscales according to the actual brightness of each pixel, collected by the optical collecting device at the each of multiple groups of grayscales.

Figure 8:
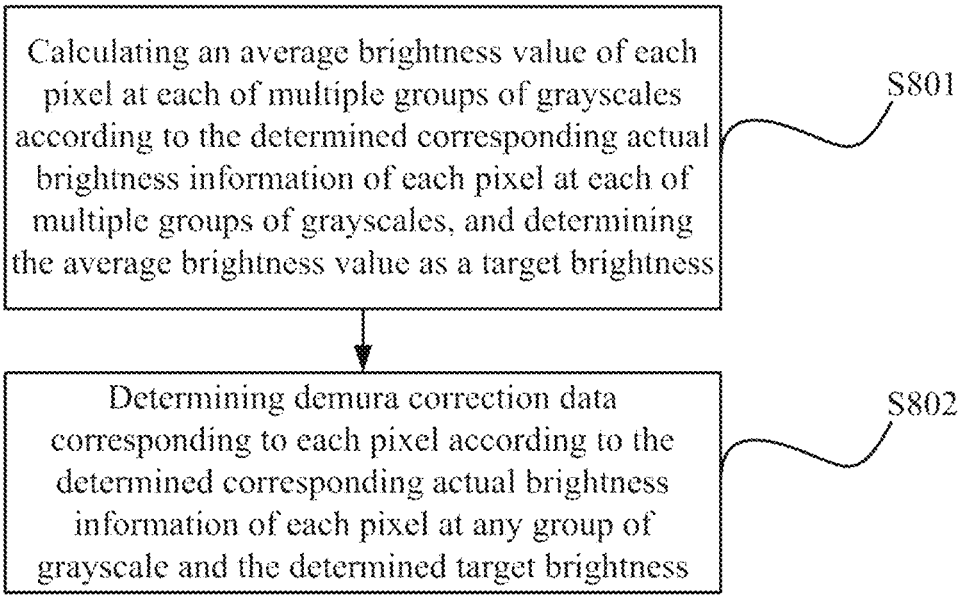
FIG. 8 is a flowchart of a method for determining demura correction data of each pixel according to an embodiment of the present disclosure.

In one embodiment, in order to determine demura correction data corresponding to each pixel, in the operation S402 in the foregoing image processing method provided in the embodiment of the present disclosure, the determining the demura correction data corresponding to each pixel according to the determined corresponding actual brightness information of each pixel at each of multiple groups of grayscales, may include the following operations, as shown in FIG. 8.

S801: calculating an average brightness value of each pixel at each of multiple groups of grayscales according to the determined corresponding actual brightness information of each pixel at each of multiple groups of grayscales, and determining the average brightness value as a target brightness, S802: determining demura correction data corresponding to each pixel according to the determined corresponding actual brightness information of each pixel at any group of grayscale and the determined target brightness.

Figure 9:
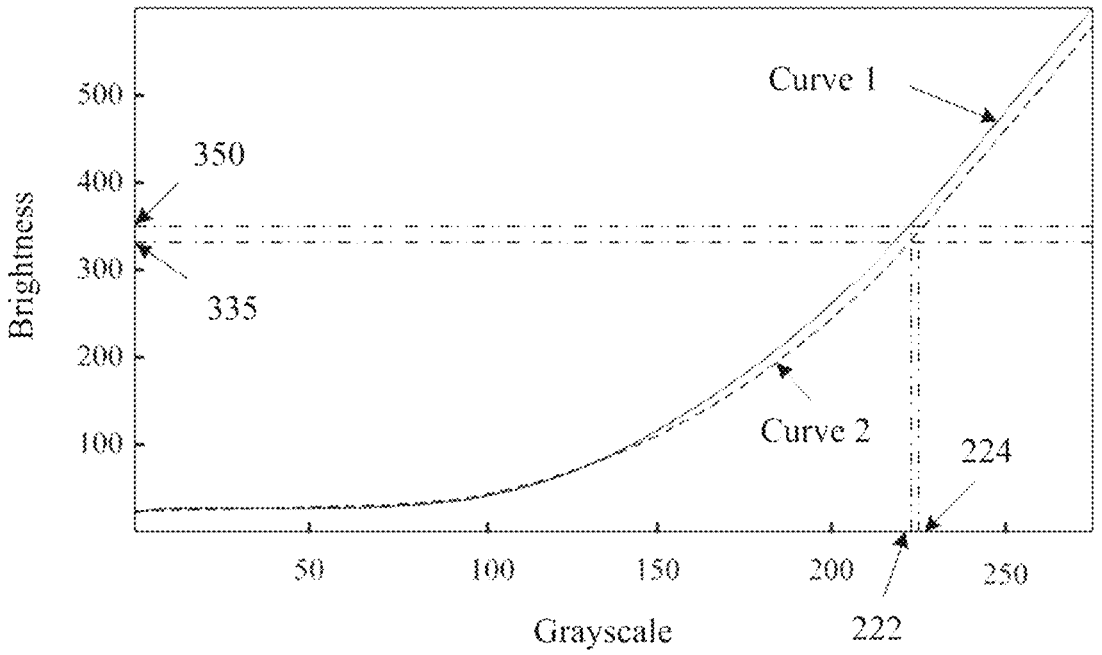
FIG. 9 is a grayscale-brightness curve graph provided in an embodiment of the present disclosure.

In one embodiment, as shown in FIG. 9, the abscissa represents the grayscale of each pixel, the ordinate represents the brightness corresponding to respective grayscales, the curve 1 represents a target brightness curve, and the curve 2 represents an actual brightness curve corresponding to any group of grayscale. Taking the pixel PX as an example, if the grayscale of the pixel PX is 222, the corresponding brightness on the target brightness curve should be 350, and the corresponding brightness on the actual brightness curve is 335. It can be seen that, at the grayscale of 222, the pixel PX does not reach the expected brightness, resulting display mora of the display panel; however, at the grayscale of 224, the corresponding brightness of the pixel PX on the actual brightness curve is 350. Therefore, in order to make the actual brightness of the pixel be 350, the grayscale of the pixel PX may need to be corrected, that is, the grayscale of the pixel PX is corrected from 222 to 224, so the demura correction data of the pixel PX is 2. In this way, the demura correction processing for the grayscale of the pixel PX is implemented, which may be beneficial to the improvement of the uneven light emission of the display panel. Similarly, the demura correction data of other pixels are obtained in the same way, and the repeated details are not described herein again.

Figure 10:
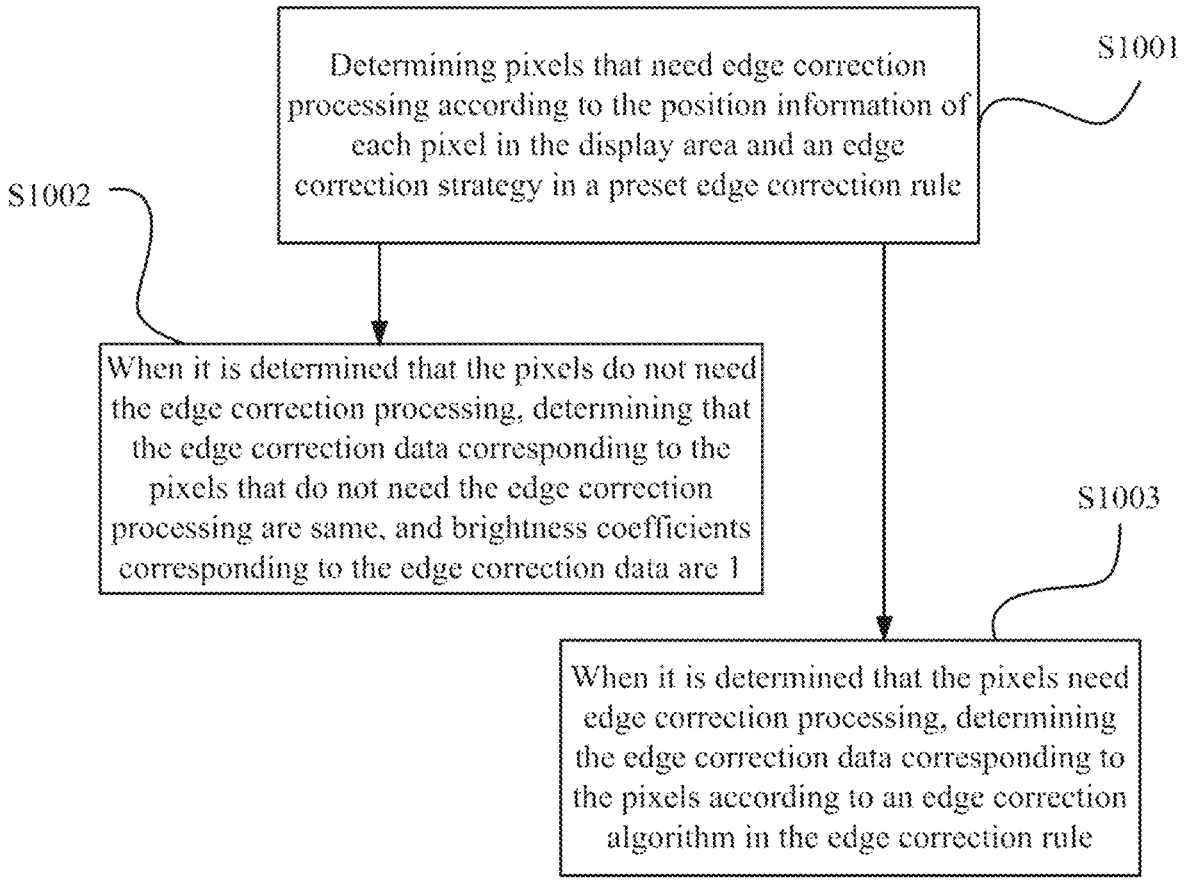
FIG. 10 is a flowchart of a method for determining edge correction data of each pixel according to an embodiment of the present disclosure.

In an implementation, in order to determine edge correction data corresponding to each pixel, in the operation S403 in the foregoing image processing method provided in the embodiment of the present disclosure, the determining edge correction data corresponding to each pixel according to the position information of each pixel in the display area and a preset edge correction rule, may include the following operations, as shown in FIG. 10.

S1001: determining pixels that may need edge correction processing according to the position information of each pixel in the display area and an edge correction strategy in a preset edge correction rule.

S1002: when it is determined that the pixels do not need the edge correction processing, determining that the edge correction data corresponding to the pixels that do not need the edge correction processing are same, and brightness coefficients corresponding to the edge correction data are 1.

S1003: when it is determined that the pixels may need edge correction processing, determining the edge correction data corresponding to the pixels according to an edge correction algorithm in the edge correction rule.

In one embodiment, since the edge of the display panel is arc-shaped, the image in this position is displayed as a sawtooth shape. The purpose of the edge correction rule is to smoothen the sawtooth at the edge, that is, along the extending direction from the center of the display panel toward the edge position, the brightness of pixels that may need edge correction processing is gradually decreased so that a smooth transition zone, instead of a sawtooth phenomenon, is shown during the viewing of an image. In one embodiment, the edge correction strategy in the edge correction rule is to set the width of the transition zone, that is, how many pixels at the edge may need edge correction processing. Therefore, according to the edge correction strategy in the edge correction rule and the position information of each pixel, which pixels may need edge correction processing and which pixels do not need edge correction processing may be determined.

Further, for those pixels that do not need edge correction processing, the corresponding edge correction data may be set to be same, and the brightness coefficients corresponding to the edge correction data may be set as 1. For those pixels that may need edge correction processing, the edge correction data corresponding to the pixels is determined according to an edge correction algorithm in the edge correction rule to realize the setting of the edge correction data for respective pixels.

In one embodiment, in the foregoing image processing method provided in the embodiment of the present disclosure, the edge correction rule at least may include: for each pixel that may need edge correction processing, the closer to the edge position of the display panel, the smaller the brightness coefficients corresponding to the edge correction data.

Figure 11:
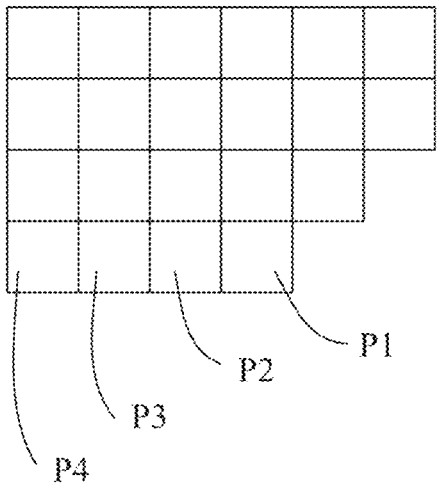
FIG. 11 is a schematic structural diagram of local pixel arrangement provided in an embodiment of the present disclosure.

For example, as shown by the schematic structural diagram of the local pixel arrangement in FIG. 11, if the pixels P1 to P3 may need edge correction processing but pixel P4 does not need the edge correction processing, and then the edge correction coefficient of the pixel 4 is 1. There may be many methods to determine the edge correction data of pixels P1 to P3: for example, the edge correction data of the pixels P1 to P3 may be determined according to the distances L from the pixels P1 to P3 to the edge of the display panel, and, if the pixel P1 is located at the edge position, the distance L of the pixel P1 may be set as 0, and since the pixel P2 is disposed adjacent to the pixel P1 in the row direction, the distance L of the pixel P2 may be set as 1; similarly, the distance L of the pixel P3 is set as 2.

In one embodiment, the brightness may be decreased by n orders, and the brightness coefficient of the X-th order is n-x/n. Then, the values of X corresponding to the distances L are preset according to the distances L from the pixels P1 to P3 to the edge of the display panel. For example, if n is 8, assuming that the distances L from the pixels P1 to P3 to the edge of the display panel respectively are 0,1 and 2, as preset that the corresponding values of X respectively are 7, 4 and 1 when L respectively is 0,1 and 2, and as stated above that the brightness coefficient of the X-th order is n-x/n, the brightness coefficients of the pixels P1 to P3 are ⅛, ⅝ and ⅞, respectively, that is, edge correction data of the pixel P1 to the pixel P3 are ⅛, ⅝ and ⅞, respectively.

In one embodiment, since each pixel comprises at least three sub-pixels during the actual fabrication of the display panel, the edge correction processing may also be implemented by adjusting the brightness of each sub-pixel in the process of determining the edge correction data of the pixels P1 to P3. In one embodiment, the edge correction data of respective sub-pixel may be determined according to the actually-set number of sub-pixels and the edge correction strategy to be satisfied. In one embodiment, a method similar to the foregoing method may also be used, which is not limited herein.

Further, when the edge correction data is stored in the calibration data table, there are many storage formats. The First format: the value of the determined edge correction data may be directly stored in the correction data table, so that it may be obtained directly when read by the drive chip. The second format: it is possible to create a look-up table when the correction date table is created; taking the edge correction data in the correction data group shown in FIG. 6A as an example, if 3 bits are the edge correction data and the edge correction data is 3-bit edge correction data consisting of 0 and 1, each three-bit edge correction data corresponds to a ratio in the edge correction data look-up table. For example, the edge correction data of the pixel P1 stored in the correction data table is 001, and the corresponding ratio of 001 in the edge correction data look-up table is 10%, and then the edge correction data of the pixel P1 is 10%. In one embodiment, both ratios corresponding to the edge correction data of the pixels that may need edge correction processing and ratios corresponding to the edge correction data of the pixels that do not need edge correction processing may be stored in the edge correction data look-up table, that may only need to set the edge correction data of the pixels that do not need edge correction processing as 000 and set the ratios corresponding to 000 in the edge correction data look-up table as 1, which is not limited herein. In one embodiment, the edge correction data look-up table may be generated along with the correction data table and then they are both stored in the flash memory. When the drive chip invokes the correction data table, the edge correction data look-up table is invoked along with the correction data table so as to implement edge correction processing on each pixel.

In an implementation, since both the edge correction data and the demura correction data include the position information of the pixels during the process of determining the edge correction data and the demura correction data of each pixel, in the foregoing image processing method provided by the embodiment of the present disclosure, as for two kinds of correction data with the same position information, a correction data group may be formed and stored in the correction data table, so as to eliminate the sawtooth phenomenon at the edge while eliminating the display mura.

It should be noted that the display panel to which the image processing method provided by the embodiment of the present disclosure is directed may be a liquid crystal display panel and may also be an electroluminescent display panel, such as an OLED display panel; as long as the display panel has arc-shaped corners, or corners of any other shapes, the foregoing image processing method provided by the embodiment of the present disclosure may be used to perform edge correction processing while performing demura correction processing on the display panel, so as to effectively improve the display effect of the display panel.

The aforementioned image processing method provided by the embodiment of the present disclosure will be described below as embodiments in details.

Figure 12:
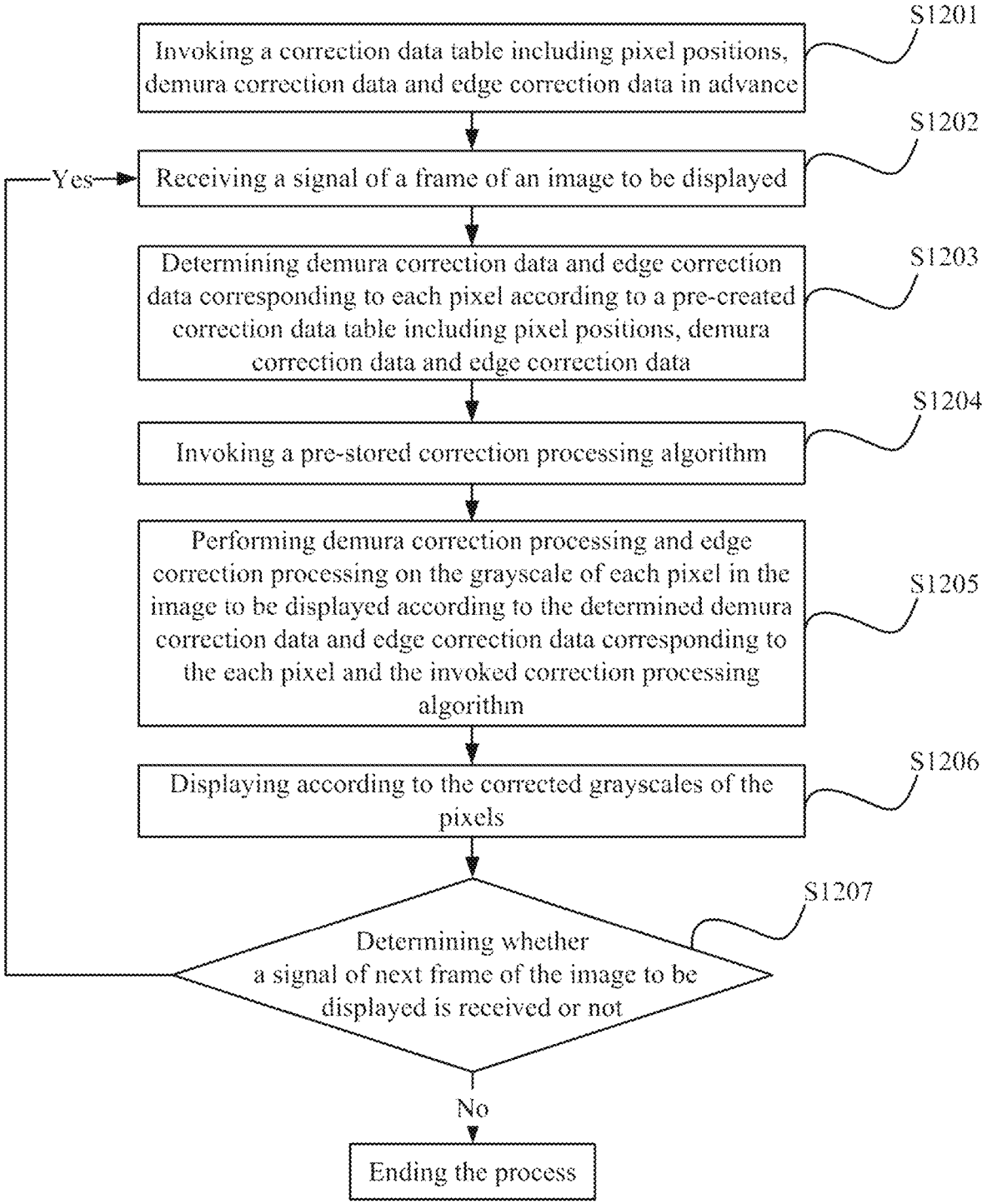
FIG. 12 is a flowchart of a method in an embodiment provided in embodiments of the present disclosure.

In one embodiment, the detailed description will be made with reference to the flowchart shown in FIG. 12.

S1201: invoking a correction data table including pixel positions, demura correction data and edge correction data in advance.

S1202: receiving a signal of a frame of an image to be displayed.

S1203: determining demura correction data and edge correction data corresponding to each pixel according to a pre-created correction data table including pixel positions, demura correction data and edge correction data.

S1204: invoking a pre-stored correction processing algorithm.

S1205: performing demura correction processing and edge correction processing on the grayscale of each pixel in the image to be displayed according to the determined demura correction data and edge correction data corresponding to each pixel and the invoked correction processing algorithm.

S1206: displaying according to the corrected grayscales of the pixels.

S1207: determining whether a signal of next frame of the image to be displayed is received or not; if yes, returning to the operation S1202; otherwise, ending the process.

Based on the same inventive concept, an embodiment of the present disclosure further provides an image processing apparatus. Because the operating principle of the image processing apparatus is similar to that of the foregoing image processing method, for implementation of the image processing apparatus provided by the embodiment of the present disclosure, reference may be made to the foregoing image processing method, and details are not described herein again.

Figure 13:
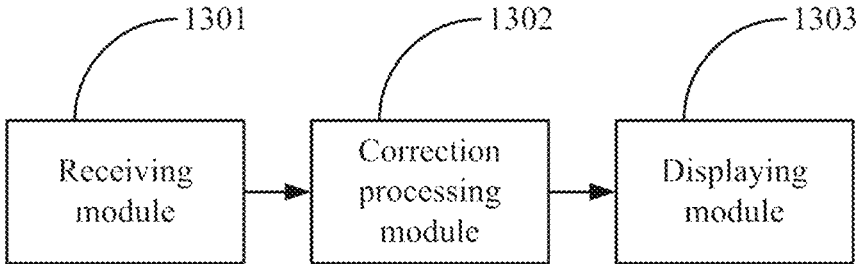
FIG. 13 is a first structural schematic diagram of an image processing apparatus provided in an embodiment of the present disclosure.

In one embodiment, the image processing apparatus provided in the embodiment of the present disclosure, as shown in FIG. 13, may include: a receiving device 1301 configured to receive a signal of an image to be displayed; a correction processing device 1302 configured to correct the grayscale of each pixel in the image to be displayed according to a pre-created correction data table including pixel positions, display correction data and edge correction data; and a displaying device 1303 configured to perform a display operation according to the corrected grayscales of the pixels.

The image processing apparatus provided in the embodiment of the present disclosure may correct the grayscales of pixels in the image to be displayed, without being limited by the shape of a display panel, and may be applied to a display panel of any shape, thus achieving high flexibility. In addition, since the display correction data and edge correction data of each pixel are included in the pre-created correction data table, the display correction data and the edge correction data may be merged into one table and logic sources occupied in the image processing apparatus may be effectively reduced. Moreover, the edge effects of respective pixels are corrected while the display effect is corrected, thus effectively improving the display effect of a display.

In an implementation, in order to correct the grayscale of each pixel in the image to be displayed, in the image processing apparatus provided by the embodiment of the present disclosure, the display correction data is demura correction data.

Figure 14:
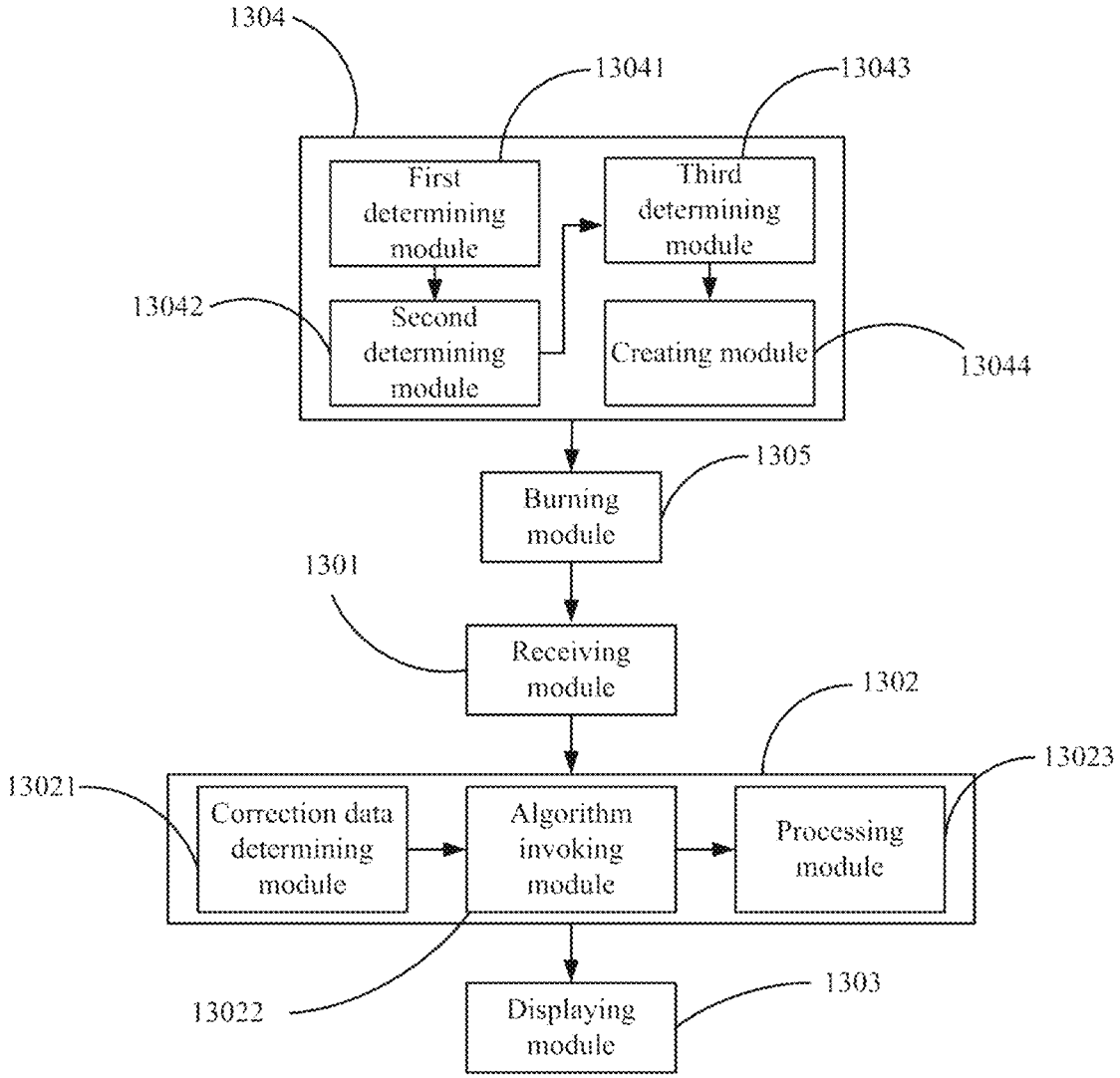
FIG. 14 is a second structural schematic diagram of an image processing apparatus provided in an embodiment of the present disclosure.

As shown in FIG. 14, the correction processing device 1302 may include a correction data determining device 13021, an algorithm invoking device 13022 and a processing device 13023.

Where the correction data determining device 13021 is configured to determine the demura correction data and edge correction data corresponding to each pixel according to a pre-created correction data table including pixel positions, demura correction data and edge correction data.

The algorithm invoking device 13022 is configured to invoke a pre-stored correction processing algorithm.

The processing device 13023 is configured to perform demura correction processing and edge correction processing on the grayscale of each pixel in the image to be displayed according to the determined demura correction data and edge correction data corresponding to each pixel and the invoked correction processing algorithm.

In one embodiment, in order to perform demura correction processing and edge correction processing on grayscales of the pixels in the image to be displayed, in the image processing apparatus provided in the embodiment of the present disclosure, the processing device 13023 is configured to perform demura correction processing and edge correction processing on the grayscales of the pixels in the image to be displayed by using the following formula:

$$B_x=(A_x+D_{1x})\times D_{2x}$$

where $A_x$ represents the grayscale of the X-th pixel before performing the demura correction processing and the edge correction processing, $B_x$ represents the grayscale of the X-th pixel after performing the demura correction processing and the edge correction processing, $D_{1x}$ represents the demura correction data corresponding to the X-th pixel, and $D_{2x}$represents the edge correction data corresponding to the X-th pixel.

In an implementation, in order to create a correction data table, before the receiving device 1301, as shown in FIG. 14, the image processing apparatus provided in the embodiment of the present disclosure may further include: a correction data table creating device 1304.

The correction data table creating device 1304 is configured to create a correction data table including pixel positions, demura correction data and edge correction data in advance.

In one embodiment, in the image processing apparatus provided in the embodiment of the present disclosure, the correction data table creating device 1304, as shown in FIG. 14, may include: a first determining device 13041 configured to determine corresponding actual brightness information of each pixel at each of multiple groups of grayscales; a second determining device 13042 configured to determine demura correction data corresponding to each pixel according to the determined corresponding actual brightness information of each pixel at each of multiple groups of grayscales; a third determining device 13043 configured to determine edge correction data corresponding to each pixel according to the determined position information of each pixel and a preset edge correction rule; and a creating device 13044 configured to create a correction data table including pixel positions, demura correction data and edge correction data according to the determined edge correction data and demura correction data corresponding to each pixel and the pixel position of each pixel in the display panel.

In one embodiment, in the image processing apparatus provided in the embodiment of the present disclosure, positions of each pixel in the correction data table and the positions of each pixel in the display area are in one-to-one correspondence; and a correction data group, which is composed of demura correction data and edge correction data corresponding to a pixel, is stored in the position of the pixel in the correction data table.

Further, in the image processing apparatus provided by the embodiment of the present disclosure, the correction data group includes n bits, of which in bits are edge correction data and (n-m) bits are demura correction data; where n is 8 or 10, and m is a positive integer less than n.

In one embodiment, in the image processing apparatus provided by the embodiment of the present disclosure, the first determining device 13041 is configured to light the display panel at multiple groups of grayscales respectively; collect the actual brightness of each pixel at each of multiple groups of grayscales using an optical collecting device; and determine corresponding actual brightness information of each pixel at each of multiple groups of grayscales according to the actual brightness of each pixel, collected by the optical collecting device at the each of multiple groups of grayscales.

The second determining device 13042 is configured to calculate an average brightness value of each pixel at each of multiple groups of grayscales according to the determined corresponding actual brightness information of each pixel at each of multiple groups of grayscales, and determine the average brightness value as target brightness; and configured to determine the demura correction data corresponding to each pixel according to the determined corresponding actual brightness value of each pixel at any group of grayscale and the determined target brightness.

In one embodiment, in the image processing apparatus provided in the embodiment of the present disclosure, the third determining device 13043 is configured to: determine pixels that may need edge correction processing, according to the position information of each pixel in the display area and an edge correction strategy in the preset edge correction rule; when it is determined that the pixels do not need the edge correction processing, determine that the edge correction data corresponding to the pixels that do not need the edge correction processing are same and brightness coefficients corresponding to the edge correction data are 1; and when it is determined that the pixels may need edge correction processing, determine the edge correction data corresponding to the pixels according to an edge correction algorithm in the edge correction rule.

Further, in the image processing method provided in the embodiment of the present disclosure, the edge correction rule at least includes: for respective pixels that may need edge correction processing, the closer to the edge position of the display panel, the smaller the edge correction data.

In an implementation, in order to store the created correction data table, the image processing apparatus provided in the embodiment of the present disclosure, as shown in FIG. 14, may further include: a burning device 1305.

The burning device 1305 is configured to burn the correction data table onto a memory after the correction data table including pixel positions, demura correction data and edge correction data is created.

In an implementation, the correction data table creating device 1304 and the burning device 1305 may both belong to a flash memory, and may also belong to other non-volatile memories. And both the correction data table creating device 1304 and the burning device 1305 are external devices and generally arranged outside the display apparatus. The receiving device 1301 and the correction processing device 1302 may both belong to a drive chip. This arrangement may effectively reduce the occupied memory of the drive chip and therefore improve the processing speed of the drive chip. In addition, the displaying device 1303 may be a display panel for displaying a corrected image. Therefore, the receiving device 1301, the correction processing device 1302 and the displaying device 1303 belong to internal devices and are generally arranged inside the display apparatus.

Figure 15:
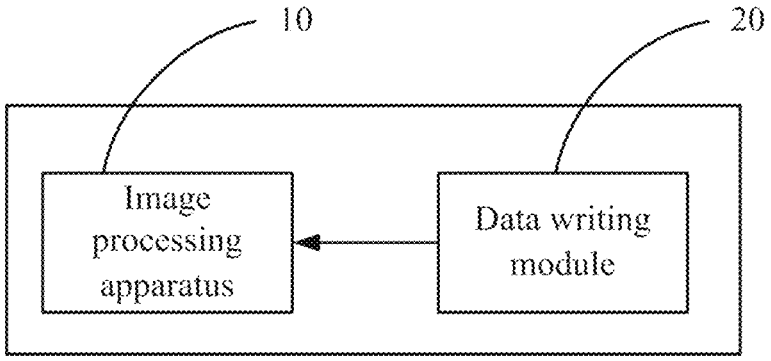
FIG. 15 is a structural schematic diagram of an image processing system provided in an embodiment of the present disclosure.

Based on the same inventive concept, an embodiment of the present disclosure further provides an image processing system, as shown in FIG. 15, including: the above image processing apparatus 10 provided in the embodiment of the present disclosure. Because the operating principle of the image processing system is similar to that of the foregoing image processing apparatus, for implementation of the image processing system provided in the embodiment of the present disclosure, reference may be made to the foregoing image processing method, and repeated details are not described herein again.

In an implementation, in order to enable the display panel to display an image, the image processing system provided in the embodiment of the present disclosure, as shown in FIG. 15, may further include a data writing device 20, configured to input a data of an image to be display into the image processing apparatus 10 so that the image processing apparatus 10 corrects the data of the image to be displayed and then outputs and displays the data.

Figure 16:
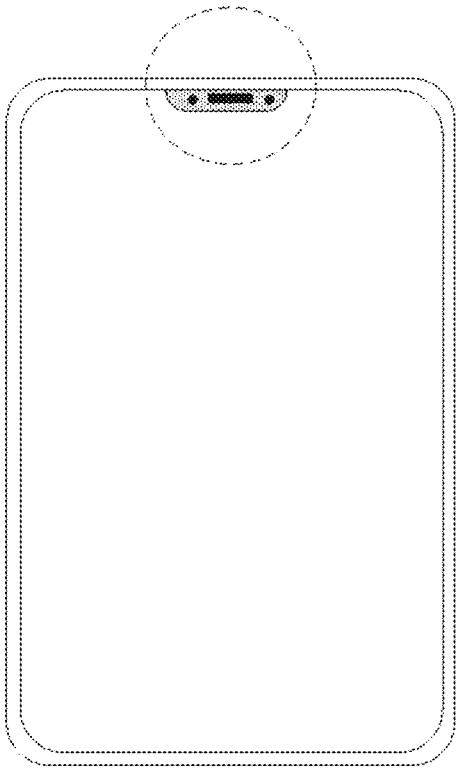
FIG. 16 is a structural schematic diagram of a display apparatus provided in an embodiment of the present disclosure.

Based on the same inventive concept, an embodiment of the present disclosure further provides a display apparatus, including: the receiving device, the correction processing device and the displaying device in the above image processing apparatus provided in the embodiment of the present disclosure. The display apparatus may be any product or component having a display function, such as a mobile phone (as shown in FIG. 16), a tablet computer, a television, a display, a notebook computer, a digital photo frame and a navigator. For the implementation of the display apparatus, reference may be made to the embodiment of the foregoing image processing system, and repeated details are not repeated herein.

In an implementation, in a full-screen mobile phone shown in FIG. 16, a hollow structure (as shown by a dotted circle) is usually arranged at the top for installing a telephone receiver, a front camera, and various identification devices (such as face recognition and iris recognition), so that the edge position is not a standard circular arc angle. However, when performing the edge correction processing, the image processing system in the foregoing display apparatus provided in the embodiment of the present disclosure is not limited by shape and may perform edge correction processing on the edge of any shape to effectively alleviate the sawtooth phenomenon on the edge of the full screen as shown in FIG. 16, thus effectively improving the display effect and the viewing effect of the display apparatus.

Figure 17:
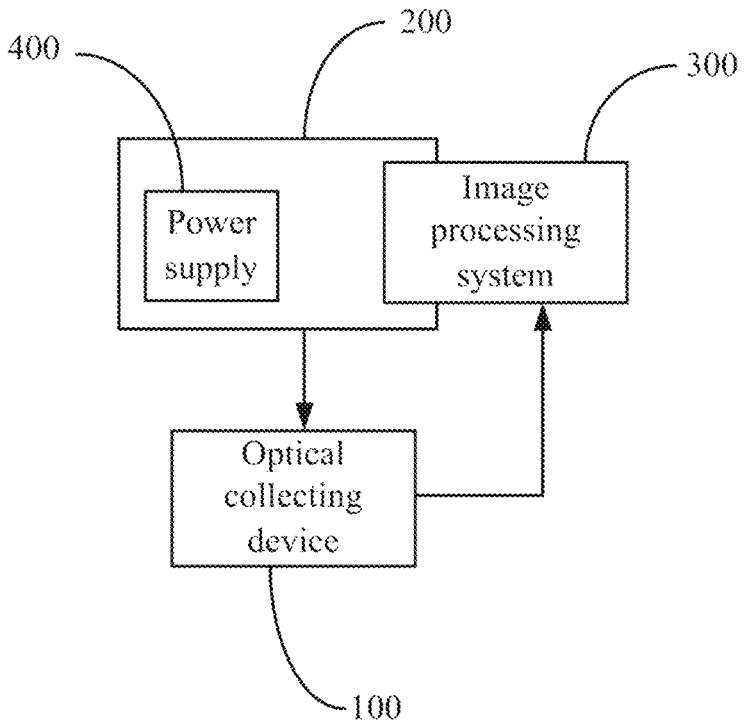
FIG. 17 is a structural schematic diagram showing a relationship among a display apparatus, an image processing system and an optical collecting device provided in an embodiment of the present disclosure.

In one embodiment, in order to implement the functions of the display apparatus provided in the embodiment of the present disclosure, as shown in FIG. 17, an optical collecting device 100 is further needed to collect the brightness information of each pixel in the display apparatus 200 and output the collected brightness information to the image processing system 300 so as to process the image to be displayed. In one embodiment, the optical collecting device 100 may be any device capable of collecting the brightness information of each pixel in the display apparatus, which is not limited herein.

In one embodiment, in order to light the display apparatus 200 so that the optical collecting device 100 collects the brightness information of each pixel in the display apparatus 200, the display apparatus provided by the embodiment of the present disclosure may further include: a power supply 400 for lighting the display apparatus 200 so that the optical collecting device 100 collects the brightness information, as shown in FIG. 17. In one embodiment, the power supply 400 may be a battery (as shown in FIG. 17) in the display apparatus 200 or other power supply structures, which is not limited herein.

Embodiments of the present application may be provided as a method, a system, or a computer program product. Accordingly, this application may take the form of an entirely hardware embodiment, an entirely software embodiment, or an embodiment combining software and hardware. Also, this application may take the form of a computer program product implemented on one or more computer storage media (including, but not limited to, magnetic disk storage and optical storage) including computer program codes.

This application is described with reference to the flowcharts and/or the block diagrams of a method, a device (system), and a computer program product according to the embodiments of this application. It will be understood that each process and/or block in the flowcharts and/or block diagrams, and combinations of the processes and/or blocks in the flowcharts and/or the block diagrams, may be implemented by computer program instructions. These computer program instructions may be provided to a processor of a general-purpose computer, a special-purpose computer, an embedded processor, or other programmable data processing devices to produce a machine such that the instructions are executed by the processor of the computer or other programmable data processing devices to generate an apparatus for implementing the functions specified in one or more processes in the flowcharts and/or one or more blocks in the block diagrams.

These computer program instructions may also be stored in a computer readable memory that may direct a computer or other programmable data processing devices to function in a particular manner such that the instructions stored in the computer readable memory produce an article of manufacture including an instruction means which implements functions specified in one or more processes in the flowcharts and/or one or more blocks in the block diagrams.

These computer program instructions may also be loaded onto a computer or other programmable data processing devices to cause a series of operating steps to be performed on the computer or other programmable devices to produce computer-implemented processing, and the instructions executed on a computer or other programmable devices provide steps for implementing the functions specified in one or more processes in the flowcharts and/or one or more blocks in the block diagrams.

The embodiments of the present disclosure provide an image processing method, an image processing apparatus, an image processing system and a display apparatus. Where the image processing method includes: receiving a signal of an image to be displayed; correcting the grayscale of each pixel in the image to be displayed according to a pre-created correction data table including pixel positions, display correction data and edge correction data; and performing a display operation according to the corrected grayscales of the pixels. Therefore, the grayscales of pixels in the image to be displayed may be corrected according to the pre-created correction data table including pixel positions, display correction data and edge correction data, without being limited by the shape of a display panel, and thus the method with high flexibility may be applied to a display panel of any shape. In addition, since the display correction data and edge correction data of each pixel are included in the pre-created correction data table, the display correction data and the edge correction data may be merged into one table and logic sources occupied in an image processing system may be effectively reduced. Moreover, the edge effects of respective pixels are corrected while the display effect is corrected, thus effectively improving the display effect of a display.

The invention claimed is:

1. An apparatus for processing an image to be displayed by a display panel with an irregular outline shape, comprising:

a correction data table creating device, configured to create a correction data table comprising pixel positions, demura correction data and edge correction data;

a receiving device, configured to receive a signal of the image to be displayed;

a correction data determining device, configured to determine demura correction data and edge correction data corresponding to each pixel according to the correction data table comprising pixel positions, demura correction data and edge correction data;

an algorithm invoking device, configured to invoke a pre-stored correction processing algorithm; and a processing device, configured to perform demura correction processing and edge correction processing on a grayscale of each pixel in the image to be displayed according to the determined demura correction data and the determined edge correction data corresponding to each pixel and the invoked correction processing algorithm; and a displaying device, configured to display according to the corrected grayscale of each pixel;

wherein the correction data table creating device comprises:

a first determining device, configured to determine corresponding actual brightness information of each pixel at each of multiple groups of grayscales;

a second determining device, configured to determine demura correction data corresponding to each pixel according to the determined corresponding actual brightness information of each pixel at each of multiple groups of grayscales;

a third determining device, configured to determine edge correction data corresponding to each pixel according to determined position information of each pixel and a preset edge correction rule; and a creating device, configured to create the correction data table comprising pixel position, demura correction data and edge correction data according to the determined corresponding edge correction data and demura correction data of each pixel and pixel positions of each pixel in a display panel; and wherein the third determining device is configured to: determine pixels that need edge correction processing, according to the determined position information of each pixel in a display area and an edge correction strategy in the preset edge correction rule; when determining that pixels do not need the edge correction processing, determine that the edge correction data corresponding to the pixels that do not need the edge correction processing are same and brightness coefficients corresponding to the edge correction data are 1; and when determining that pixels need the edge correction processing, determine edge correction data corresponding to the pixels according to an edge correction algorithm in the preset edge correction rule.

2. The apparatus according to claim 1, wherein the processing device is configured to perform demura correction processing and edge correction processing on the grayscale of each pixel in the image to be displayed by using following formula:

$$B_x=(A_x+D_{1x})\times D_{2x}$$

wherein $A_x$ represents a grayscale of an X-th pixel before performing the demura correction processing and the edge correction processing, $B_x$ represents a grayscale of the X-th pixel after performing the demura correction processing and the edge correction processing, $D_{1x}$ represents a demura correction data corresponding to the X-th pixel, and $D_{2x}$ represents an edge correction data corresponding to the X-th pixel.

3. The apparatus according to claim 1, wherein positions of each pixel in the correction data table and positions of each pixel in a display area are in one-to-one correspondence; and a correction data group, which is composed of demura correction data and edge correction data corresponding to a pixel, is stored in a position of the pixel in the correction data table; and wherein the correction data group comprises n bits, of which m bits are edge correction data and n-m bits are demura correction data; wherein n is 8 or 10, and m is a positive integer less than n.

4. The apparatus according to claim 1, wherein the first determining device is configured to light the display panel at multiple groups of grayscales respectively; collect actual brightness of each pixel at each of multiple groups of grayscales using an optical collecting device; and determine corresponding actual brightness information of each pixel at each of multiple groups of grayscales according to actual brightness of each pixel, collected by the optical collecting device at the each of multiple groups of grayscales; and the second determining device is configured to calculate an average brightness value of each pixel at each of multiple groups of grayscales according to the determined corresponding actual brightness information of each pixel at each of multiple groups of grayscales, determine the average brightness value as a target brightness; and determine demura correction data corresponding to each pixel according to the determined corresponding actual brightness value of each pixel at any group of grayscale and the determined target brightness.

5. The apparatus according to claim 1, wherein the edge correction rule at least comprises: for the pixels that need edge correction processing, the closer to an edge position of the display panel, the smaller the edge correction data.

6. The apparatus according to claim 1, further comprising:

a burning device; and wherein the burning device is configured to burn the correction data table onto a memory after the correction data table comprising pixel position, demura correction data and edge correction data is created.

7. A method for processing an image to be displayed by a display panel with an irregular outline shape, comprising:

creating a correction data table comprising pixel positions, display correction data and edge correction data;

receiving a signal of the image to be displayed;

determining demura correction data and edge correction data corresponding to each pixel according to the correction data table comprising pixel positions, demura correction data and edge correction data;

invoking a pre-stored correction processing algorithm;

performing demura correction processing and edge correction processing on a grayscale of each pixel in the image to be displayed according to the determined demura correction data and the determined edge correction data corresponding to each pixel and the invoked correction processing algorithm; and displaying according to the corrected grayscale of each pixel;

wherein the creating the correction data table comprises:

determining corresponding actual brightness information of each pixel at each of each of multiple groups of grayscales;

determining demura correction data corresponding to each pixel according to the determined corresponding actual brightness information of each pixel at each of multiple groups of grayscales;

determining edge correction data corresponding to each pixel according to determined position information of each pixel and a preset edge correction rule; and creating the correction data table comprising pixel positions, demura correction data and edge correction data according to the determined corresponding edge correction data and demura correction data of each pixel and pixel positions of each pixel in a display panel; and wherein the determining edge correction data corresponding to each pixel according to the position information of each pixel in a display area and the preset edge correction rule comprises:

determining pixels that need edge correction processing according to the position information of each pixel in the display area and an edge correction strategy in the preset edge correction rule;

when determining that pixels do not need edge correction processing, determining that the edge correction data corresponding to the pixels that do not need the edge correction processing are same and brightness coefficients corresponding to the edge correction data is 1; and when determining that pixels need edge correction processing, determining edge correction data corresponding to the pixels according to an edge correction algorithm in the edge correction rule.

8. The method according to claim 7, wherein the performing demura correction processing and edge correction processing on the grayscale of each pixel in the image to be displayed according to the determined demura correction data and edge correction data corresponding to each pixel and the invoked correction processing algorithm comprises:

performing demura correction processing and edge correction processing on grayscales of the pixels in the image to be displayed by using following formula:

$$B_x=(A_x+D_{1x})\times D_{2x}$$

wherein $A_x$ represents a grayscale of an X-th pixel before performing the demura correction processing and the edge correction processing, $B_x$ represents a grayscale of the X-th pixel after performing the demura correction processing and the edge correction processing, $D_{1x}$ represents a demura correction data corresponding to the X-th pixel, and $D_{2x}$ represents an edge correction data corresponding to the X-th pixel.

9. The method according to claim 7, wherein positions of each pixel in the correction data table and positions of each pixel in a display area are in one-to-one correspondence; and a correction data group, which is composed of demura correction data and edge correction data corresponding to a pixel, is stored in a position of the pixel in the correction data table.

10. The method according to claim 9, wherein the correction data group comprises n bits, of which m bits are edge correction data and n-m bits are demura correction data; and wherein n is 8 or 10, and m is a positive integer less than n.

11. The method according to claim 7, wherein the determining corresponding actual brightness information of each pixel at each of multiple groups of grayscales comprises:

lighting the display panel at multiple groups of grayscales respectively;

collecting actual brightness of each pixel at each of multiple groups of grayscales using an optical collecting device;

determining corresponding actual brightness information of each pixel at each of multiple groups of grayscales according to actual brightness of each pixel, collected by the optical collecting device at the each of multiple groups of grayscales;

the determining demura correction data corresponding to each pixel according to the determined corresponding actual brightness information of each pixel at each of multiple groups of grayscales comprises:

calculating an average brightness value of each pixel at each of multiple groups of grayscales according to the determined corresponding actual brightness information of each pixel at each of multiple groups of grayscales, and determining the average brightness value as a target brightness; and determining demura correction data corresponding to each pixel according to the determined corresponding actual brightness information of each pixel at any group of grayscale and the determined target brightness.

12. The method according to claim 7, wherein the edge correction rule at least comprises: for the pixels that need edge correction processing, the closer to an edge position of the display panel, the smaller the edge correction data.

13. The method according to claim 7, wherein burning the correction data table onto a memory after the correction data table comprising pixel position, demura correction data and edge correction data is created.

14. A method for processing an image to be displayed by a display panel with an irregular outline shape, comprising:

receiving a signal of the image to be displayed;

determining demura correction data and edge correction data corresponding to each pixel according to a pre-created correction data table comprising pixel positions, demura correction data and edge correction data;

performing demura correction processing and edge correction processing on grayscales of the pixels in the image to be displayed by using following formula:

$$B_x=(A_x+D_{1x})\times D_{2x}$$

wherein $A_x$ represents a grayscale of an X-th pixel before performing the demura correction processing and the edge correction processing, $B_X$ represents a grayscale of the X-th pixel after performing the demura correction processing and the edge correction processing, $D_{1x}$ represents a demura correction data corresponding to the X-th pixel, and $D_{2x}$ represents an edge correction data corresponding to the X-th pixel; and displaying according to a corrected grayscale of each pixel.

15. The method according to claim 14, wherein a method of creating a correction data table comprising pixel positions, display correction data and edge correction data before receiving the signal of the image to be displayed comprises:

determining corresponding actual brightness information of each pixel at each of each of multiple groups of grayscales;

determining demura correction data corresponding to each pixel according to the determined corresponding actual brightness information of each pixel at each of multiple groups of grayscales;

determining edge correction data corresponding to each pixel according to the determined position information of each pixel and a preset edge correction rule; and creating the correction data table comprising pixel positions, demura correction data and edge correction data according to the determined corresponding edge correction data and demura correction data of each pixel and pixel positions of each pixel in a display panel.

16. The method according to claim 15, wherein positions of each pixel in the correction data table and positions of each pixel in a display area are in one-to-one correspondence; and a correction data group, which is composed of demura correction data and edge correction data corresponding to a pixel, is stored in a position of the pixel in the correction data table.

17. The method according to claim 16, wherein the correction data group comprises n bits, of which m bits are edge correction data and n-m bits are demura correction data; and wherein n is 8 or 10, and m is a positive integer less than n.

18. The method according to claim 15, wherein the determining corresponding actual brightness information of each pixel at each of multiple groups of grayscales comprises:

lighting the display panel at multiple groups of grayscales respectively;

collecting actual brightness of each pixel at each of multiple groups of grayscales using an optical collecting device;

determining corresponding actual brightness information of each pixel at each of multiple groups of grayscales according to actual brightness of each pixel, collected by the optical collecting device at the each of multiple groups of grayscales;

the determining demura correction data corresponding to each pixel according to the determined corresponding actual brightness information of each pixel at each of multiple groups of grayscales comprises:

calculating an average brightness value of each pixel at each of multiple groups of grayscales according to the determined corresponding actual brightness information of each pixel at each of multiple groups of grayscales, and determining the average brightness value as a target brightness; and determining demura correction data corresponding to each pixel according to the determined corresponding actual brightness information of each pixel at any group of grayscale and the determined target brightness.

19. The method according to claim 15, wherein the determining edge correction data corresponding to each pixel according to position information of each pixel in a display area and the preset edge correction rule comprises:

determining pixels that need edge correction processing according to the position information of each pixel in the display area and an edge correction strategy in the preset edge correction rule;

when determining that pixels do not need edge correction processing, determining that the edge correction data corresponding to the pixels that do not need the edge correction processing are same and brightness coefficients corresponding to the edge correction data is 1; and when determining that pixels need edge correction processing, determining edge correction data corresponding to the pixels according to an edge correction algorithm in the edge correction rule.

20. The method according to claim 19, wherein the edge correction rule at least comprises: for the pixels that need edge correction processing, the closer to an edge position of the display panel, the smaller the edge correction data.

* * * * *